US005532551A

United States Patent [19]

Kyushima et al.

[11] Patent Number: 5,532,551

[45] Date of Patent: *Jul. 2, 1996

[54] PHOTOMULTIPLIER FOR CASCADE-MULTIPLYING PHOTOELECTRONS

[75] Inventors: Hiroyuki Kyushima; Koji Nagura; Yutaka Hasegawa; Eiichiro Kawano; Tomihiko Kuroyanagi; Akira Atsumi; Masuya Mizuide, all of Hamamatsu, Japan

[73] Assignee: Hamamatsu Photonics K.K., Hamamatsu, Japan

[ * ] Notice: The term of this patent shall not extend beyond the expiration date of Pat. No. 5,498,926.

[21] Appl. No.: 234,020

[22] Filed: Apr. 28, 1994

[30] Foreign Application Priority Data

Apr. 28, 1993 [JP] Japan ..... 5-102910

[51] Int. Cl.[6] ..... H01J 43/06

[52] U.S. Cl. ..... 313/533; 313/532; 313/537; 313/541; 313/544; 313/103 CM; 250/214 VT

[58] Field of Search ..... 313/532, 533, 313/534, 535, 536, 537, 540, 541, 542, 544, 103 R, 103 CM, 105 R, 105 CM; 250/214 VT

[56] References Cited

U.S. PATENT DOCUMENTS

| | | | |
|---|---|---|---|
| 4,446,401 | 5/1984 | Faulkner et al. | 313/537 |
| 4,577,137 | 3/1986 | Kaiser . | |
| 4,963,113 | 10/1990 | Muramatsu . | |
| 4,999,540 | 3/1991 | L'hermite . | |
| 5,126,629 | 6/1992 | Chopy . | |

FOREIGN PATENT DOCUMENTS

| | | |
|---|---|---|
| 0068600 | 1/1983 | European Pat. Off. . |
| 0078078 | 5/1983 | European Pat. Off. . |
| 3925776 | 3/1990 | Germany . |
| 3254058 | 11/1991 | Japan . |
| 1405256 | 10/1975 | United Kingdom . |

OTHER PUBLICATIONS

Doutot et al, "Mulitanode Photomultiplier for Detection and Localization of Low Light Level Events", Paper Presented At Nuclear Science Symposium, Washington, Oct. '86.

*Primary Examiner*—Nimeshkumar D. Patel
*Attorney, Agent, or Firm*—Cushman Darby & Cushman

[57] ABSTRACT

A photomultiplier has a focusing electrode plate for supporting focusing electrodes, provided between a photocathode and a dynode unit. Since the focusing electrode plate has holding springs which are integrally formed with the focusing electrode plate, resistance-welding becomes unnecessary to prevent field discharge. A concave portion is formed in a main surface of the focusing electrode plate to arrange an insulating member sandwiched between the focusing electrode plate and the photoelectron incidence side of the dynode unit and partially in contact with the concave portion. With this structure, discharge between the focusing electrode plate and the dynode unit can be prevented.

48 Claims, 8 Drawing Sheets

PHOTOMULTIPLIER FOR CASCADE-MULTIPLYING PHOTOELECTRONS

BACKGROUND OF THE INVENTION

1. Field of the Invention

The present invention relates to a photomultiplier for cascade-multiplying photoelectrons emitted from a photocathode in correspondence with incident light by multilayered dynodes.

2. Related Background Art

Conventionally, photomultipliers have been widely used for various measurements in nuclear medicine and high-energy physics as a y-camera, PET (Positron Emission Tomography), or calorimeter.

A conventional photomultiplier is constituted by a photocathode, provided inside a cylindrical bottomed vacuum container and deposited on the surface of a light receiving plate for receiving incident light, for emitting photoelectrons, focusing electrodes for focusing the orbits of the photoelectrons, and an electron multiplier, including an anode and a dynode unit provided between the photocathode and the anode, for receiving and cascade-multiplying the photoelectrons.

SUMMARY OF THE INVENTION

A contact terminal, a terminal holding block, and an aluminum film are required to supply a current to the photocathode. Additionally, at least four holding springs are required for one focusing electrode plate to stably support an electron multiplier with respect to the inner wall of the vacuum tube (housing). However, according to the present invention, without fixing at least seven components at predetermined positions by resistance-welding and depositing an aluminum film on the inner wall of the vacuum tube, the operation efficiency at the time of welding or assembling is improved.

When at least one contact terminal and four holding springs are provided at the time of assembly, two portions are resistance-welded for each component, and in total, ten portions must be welded. Normally, the welding points are oxidized or burred. Therefore, upon application of a high voltage, each welding point serves as an electron emitting source to cause field discharge to increase the noise.

For this reason, the photomultiplier must have a structure with a small number of welding points.

It is one of the objects of the present invention to provide a photomultiplier which decreases the number of constituent components to reduce the noise, thereby improving reliability and operation efficiency at the time of assembling and preventing discharge.

A photomultiplier according to the present invention is constituted by a photocathode and an electron multiplier including an anode and a dynode unit arranged between the photocathode and the anode.

The electron multiplier is mounted on a base member and arranged in a housing formed integral with the base member for fabricating a vacuum container. The photocathode is arranged inside the housing and deposited on the surface of a light receiving plate provided to the housing. At least one anode is supported by an anode plate and arranged between the dynode unit and the base member. The dynode unit is constituted by stacking a plurality of stages of dynode plates for respectively supporting at least one dynode for receiving and cascade-multiplying photoelectrons emitted from the photocathode in an incidence direction of the photoelectrons.

The housing may have on an inner wall thereof deposited a conductive metal for applying a predetermined voltage to the photocathode and rendered conductive by a predetermined conductive metal to equalize the potentials of the housing and the photocathode.

The photomultiplier according to the present invention has at least one focusing electrode between the dynode unit and the photocathode. The focusing electrode is supported by a focusing electrode plate. The focusing electrode plate is fixed on the electron incident side of the dynode unit through insulating members. The focusing electrode plate has holding springs and at least one contact terminal, all of which are integrally formed with this plate. The holding springs are in contact with the inner wall of the housing to hold the arrangement position of the dynode unit fixed on the focusing electrode plate through the insulating members. The contact terminal is in contact with the photocathode to equalize the potentials of the focusing electrodes and the photocathode. The contact terminal functions as a spring.

When contact terminals are not integrally formed with the focusing electrode plate, the holding springs are used as a wiring for applying a voltage to the photocathode. More specifically, a conductive metal film is formed in a predetermined region of the inner wall of the housing, and the holding springs are brought into contact with the conductive metal film to hold the dynode unit. The photomultiplier may have a structure in which the conductive metal film and the photocathode are rendered conductive by a conductive metal member to equalize the potentials of the focusing electrode plate and the photocathode.

The focusing electrode plate is fixed on the incident side of the dynode unit through insulating members. The focusing electrode plate also has a structure for effectively preventing discharge between the dynode unit and the focusing electrode plate. More specifically, a concave portion for arranging the insulating member which is partially in contact with the concave portion is formed in the main surface of the focusing electrode plate, which opposes the first-stage dynode plate of the dynode unit in parallel. In particular, a gap is formed between the main surface of the concave portion and the main surface of the insulating member to achieve the above object. Therefore, an interval from a contact portion between the focusing electrode plate and the insulating member to a contact portion between the insulating member and the first-stage dynode plate is larger than that between the focusing electrode plate and the first-stage dynode plate.

To further ensure this effect, a concave portion formed in at least one main surface of the focusing electrode can be formed in a main surface of the first-stage dynode plate, which opposes the focusing electrode plate. Although the shape of the insulating member is not particularly limited as long as the above object can be achieved, a spherical or circularly cylindrical body can be more effectively used to obtain mechanical strength.

At least one anode is supported by the anode plate. A plurality of anodes may be provided to the anode plate, and electron passage holes through which secondary electrons pass are formed in the anode plate in correspondence with positions where the secondary electrons emitted from the last stage of the dynode unit reach. Therefore, the photomultiplier has, between the anode plate and the base member, an inverting dynode plate for supporting at least one inverting dynode in parallel to the anode plate. The inverting dynode plate inverts the orbits of the secondary electrons passing through the anode plate toward the anodes. The diameter of the electron incident port (dynode unit side) of the electron passage hole formed in the anode plate is smaller than that of the electron exit port (inverting dynode plate side). The inverting dynode plate has, at positions opposing the anodes, a plurality of through holes for injecting a metal vapor to form a secondary electron emitting layer on the surface of each dynode of the dynode unit.

On the other hand, the photomultiplier according to the present invention may have, between the inverting dynode plate and the base member, a shield electrode plate for supporting at least one sealed electrode in parallel to the inverting dynode plate. The shield electrode plate inverts the orbits of the secondary electrons passing through the anode plate toward the anodes. The shield electrode plate has a plurality of through holes for injecting a metal vapor to form a secondary electron emitting layer on the surface of each dynode of the dynode unit. In place of this shield electrode plate, a surface portion of the base member opposing the anode plate may be used as an electrode and substituted for the shield electrode plate.

In particular, the electron multiplier comprises a dynode unit constituted by stacking a plurality of stages of dynode plates, the dynode plates spaced apart from each other at predetermined intervals through insulating members in an incidence direction of the electron flow, for respectively supporting at least one stage of dynodes for cascade-multiplying an incident electron flow, and an anode plate opposing the last-stage dynode plate of the dynode unit through insulating members. Each dynode plate has a first concave portion for arranging a first insulating member which is provided on the first main surface of the dynode plate and partially in contact with the first concave portion and a second concave portion for arranging a second insulating member which is provided on the second main surface of the dynode plate and partially in contact with the second concave portion (the second concave portion communicates with the first concave portion through a through hole). The first insulating member arranged on the first concave portion and the second insulating member arranged on the second concave portion are in contact with each other in the through hole. An interval between the contact portion between the first concave portion and the first insulating member and the contact portion between the second concave portion and the second insulating member is smaller than that between the first and second main surfaces of the dynode plate.

Important points to be noted in the above structure will be listed below. The first point is that gaps are formed between the surface of the first insulating member and the main surface of the first concave portion and between the second insulating member and the main surface of the second concave portion, respectively, to prevent discharge between the dynode plates. The second point is that the central point of the first insulating member, the central point of the second insulating member, and the contact point between the first and second insulating members are aligned on the same line in the stacking direction of the dynode plates so that the intervals between the dynode plates can be sufficiently maintained.

Using spherical or cylindrical bodies as the first and second insulating members, the photomultiplier can be easily manufactured. When cylindrical bodies are used, the outer surfaces of these bodies are brought into contact with each other. The shape of an insulating member is not limited to this. For example, an insulating member having an elliptical or polygonal section can also be used as long as the object of the present invention can be achieved.

In this electron multiplier, each dynode plate has an engaging member at a predetermined position of a side surface of the plate to engage with a corresponding connecting pin for applying a predetermined voltage. The engaging member is constituted by a pair of guide pieces for guiding the connecting pin. On the other hand, a portion near the end portion of the connecting pin, which is brought into contact with the engaging member, may be formed of a metal material having a rigidity lower than that of the remaining portion.

Similarly, the engaging member is also provided at a predetermined position of the side surface of the focusing electrode plate. With this structure, a desired voltage is applied to the photocathode through the focusing electrode plate.

Each dynode plate is constituted by at least two plates, each having at least one opening for forming as the dynode and integrally formed by welding such that the openings are matched with each other to function as the dynode when the two plates overlap. To integrally form these two plates by welding, each of the plates has at least one projecting piece for welding the corresponding projection pieces thereof at predetermined positions matching when the two plates overlap each other. The saide surface of the plate is located in parallel with respect to the incident direction of the photoelectrons.

According to the present invention, the focusing electrode plate for supporting the focusing electrode and the holding springs are integrally formed to decrease the number of components. For this reason, it becomes unnecessary to resistance-weld two portions for one holding spring, and the number of welding points is decreased. Therefore, field discharge upon application of a high voltage is prevented to reduce the noise. The operation efficiency at the time of welding and assembly is also improved.

In addition, according to the present invention, the focusing electrode plate for supporting at least one focusing electrode, the holding springs, and at least one contact terminal are integrally formed to decrease the number of components. For this reason, it becomes unnecessary to resistance-weld two portions for one contact terminal and two portions for one holding spring, and the number of welding points is decreased. Therefore, field discharge upon application of a high voltage is prevented to reduce the noise. The operation efficiency at the time of welding and assembling is also improved.

Further, according to the present invention, the contact terminals are directly, electrically, and mechanically connected to the photocathode to decrease the number of factors for degrading the photoelectric surface of the photocathode and the secondary electron emitting surface of the electron multiplier. For this reason, the multiplication factor of the output signal for the incident light is not decreased, thereby improving the reliability.

The focusing electrode plate has, in at least a main surface which opposes in parallel to the photoelectron incident side of the dynode unit, a concave portion for arranging the insulating member which is partially in contact with the concave portion. A desired space is formed on the main surface of this concave portion and on the surface of the insulating member. Therefore, when the focusing electrode plate is fixed to oppose the dynode unit, a structure for preventing discharge or the like can be obtained. This structure provides the same effect between the dynode plates for constituting the dynode unit.

DETAILED DESCRIPTION OF THE PREFERRED EMBODIMENT

An embodiment of the present invention will be described below with reference to FIGS. 1 to 15.

Figure 1:
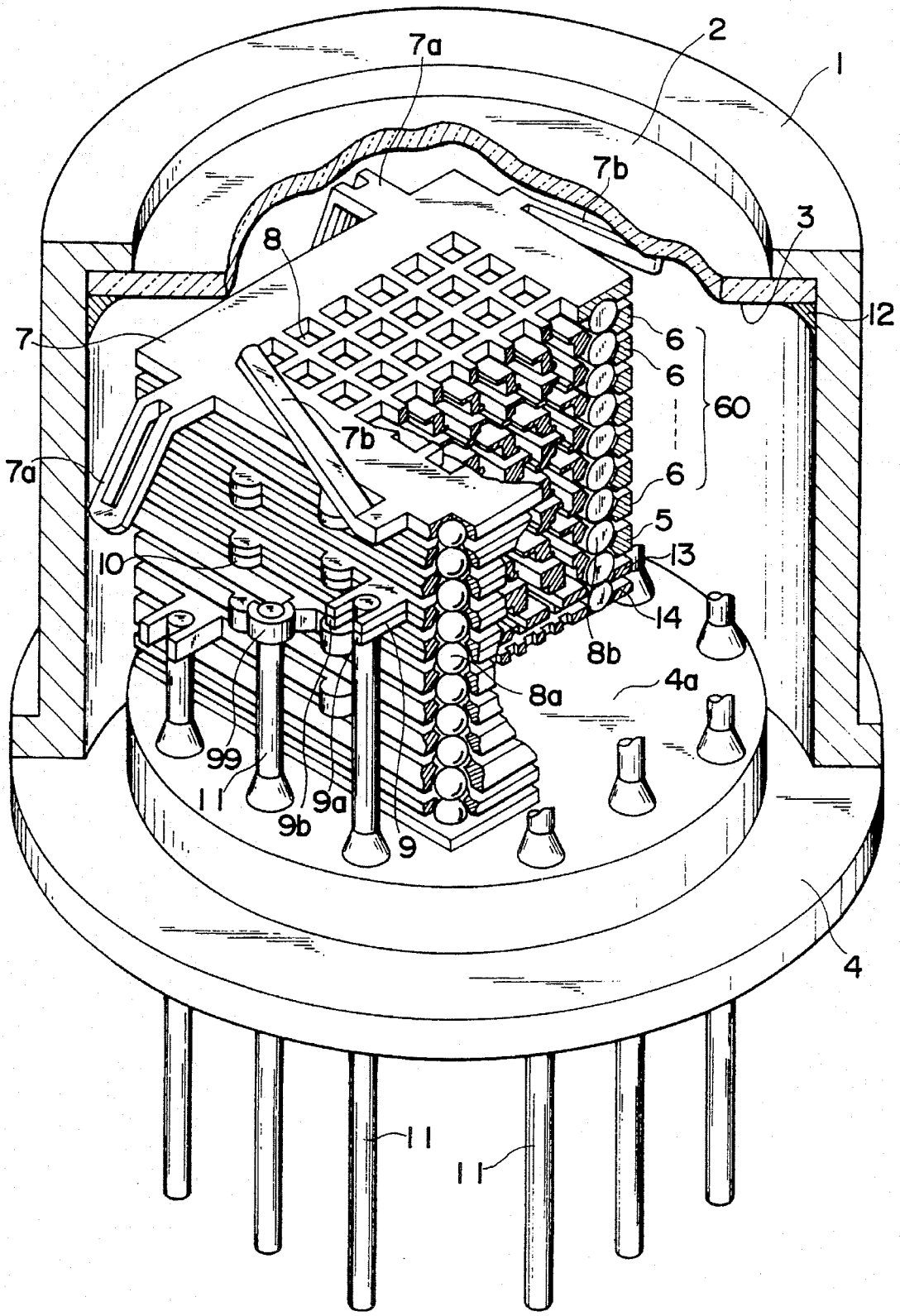
FIG. 1 is a partially cutaway perspective view showing the entire structure of a photomultiplier according to the present invention.

FIG. 1 is a perspective view showing the entire structure of a photomultiplier according to the present invention. Referring to FIG. 1, the photomultiplier is basically constituted by a photocathode 3 and an electron multiplier. The electron multiplier includes anodes (anode plate 5 ) and a dynode unit 60 arranged between the photocathode 3 and the anodes.

The electron multiplier is mounted on a base member 4 and arranged in a housing 1 which is formed integral with the base member 4 to fabricate a vacuum container. The photocathode 3 is arranged inside the housing 1 and deposited on the surface of a light receiving plate 2 provided to the housing 1. The anodes are supported by the anode plate 5 and arranged between the dynode unit 60 and the base member 4. The dynode unit 60 is constituted by stacking a plurality of stages of dynode plates 6, for respectively supporting a plurality of dynodes for receiving and cascade-multiplying photoelectrons emitted from the photocathode 3, in the incidence direction of the photoelectrons.

The photomultiplier also has focusing electrodes 8 between the dynode unit 60 and the photocathode 3 for correcting orbits of the photoelectrons emitted from the photocathode 3. These focusing electrodes 8 are supported by a focusing electrode plate 7. The focusing electrode plate 7 is fixed on the electron incidence side of the dynode unit 60 through insulating members **8*a* and 8*b*. The focusing electrode plate 7 has holding springs 7*a* and contact terminals 7*b*, all of which are integrally formed with this plate 7. The holding springs 7*a* are in contact with the inner wall of the housing 1 to hold the arrangement position of the dynode unit 60 fixed on the focusing electrode plate 7 through the insulating members 8*a* and 8*b*. The contact terminals 7*b* are in contact with the photocathode 3 to equalize the potentials of the focusing electrodes 8 and the photocathode 3. When the focusing electrode plate 7 has no contact terminal 7*b*, the housing 1 may have on an inner wall thereof deposited a conductive metal for applying a predetermined voltage to the photocathode 3, and the contact portion between the housing 1 and the photocathode 3 may be rendered conductive by a predetermined conductive metal member 12 (FIG. 13) to equalize the potentials of the housing 1 and the photocathode 3**.

Figure 2:
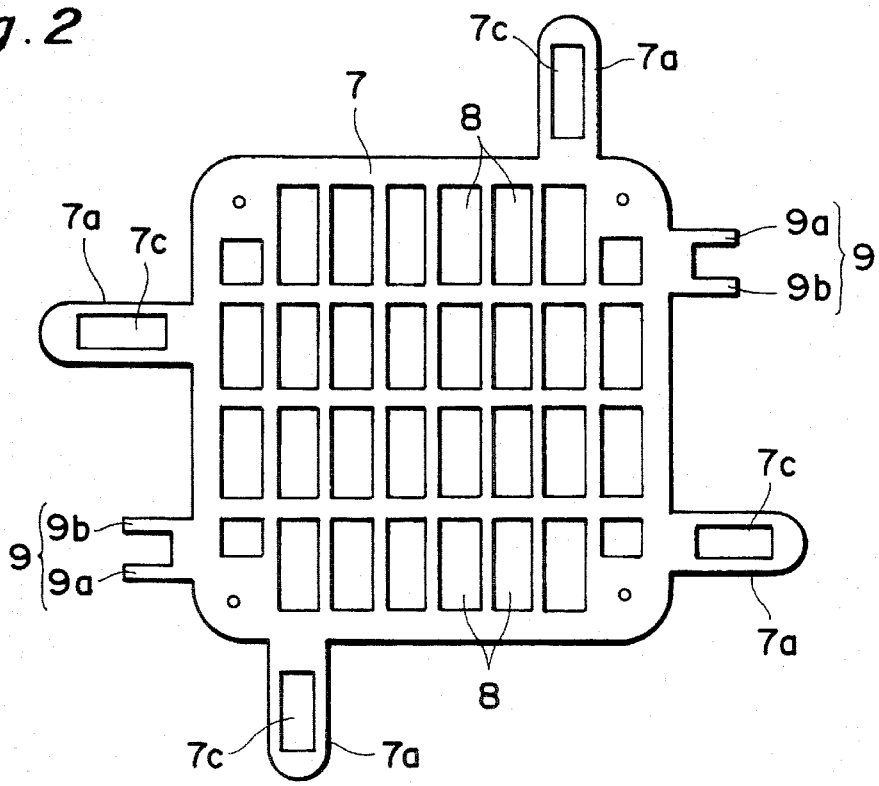
FIG. 2 is a plan view showing the shape of a focusing electrode plate as the first application.
Figure 3:
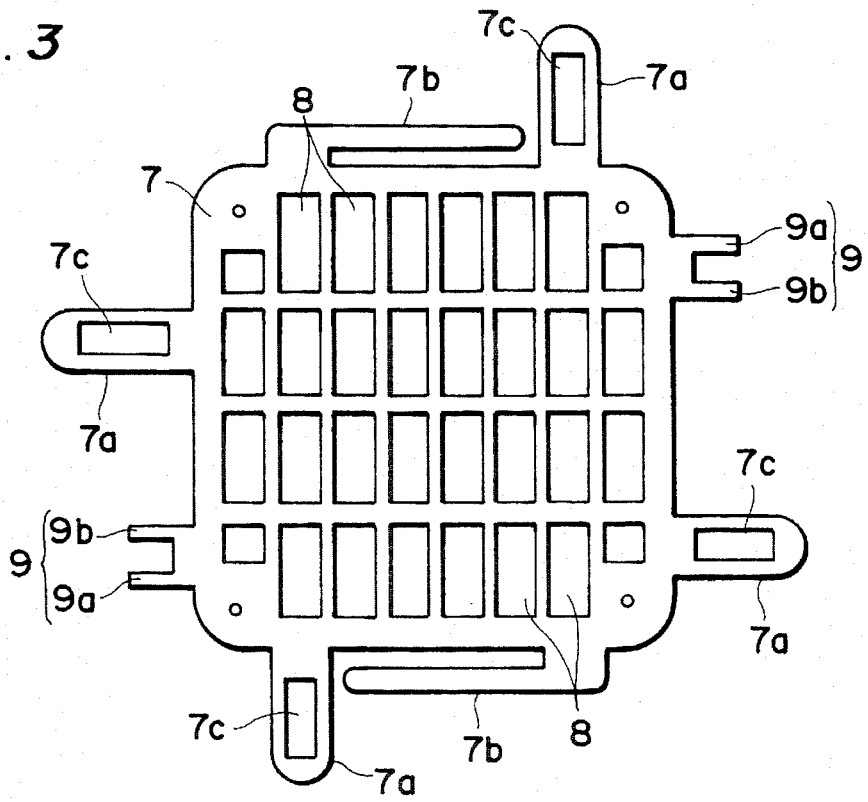
FIG. 3 is a plan view showing the shape of the focusing electrode plate as the second application.

The detailed structure of a focusing electrode plate 7 is shown in FIGS. 2 and 3. FIG. 2 shows the first application in which a plurality of focusing electrodes 8 for correcting the orbits of photoelectrons emitted from the photocathode are provided to the focusing electrode plate 7. At predetermined positions of the side surfaces of the focusing electrode plate 7, holding springs **7*a* integrally formed with the focusing electrode plate 7 are provided to hold the arrangement position of a dynode unit 60 to which the focusing electrode plate 7 is fixed through insulating meanders 8*a* and 8*b* in a housing 1. In this embodiment, the side surface of the focusing electrode plate means a surface located in parallel to the incident direction of the photoelectrons. In particular, a hole 7*c* is formed in each holding spring 7*a*** to obtain an appropriate elastic force.

Figure 5:
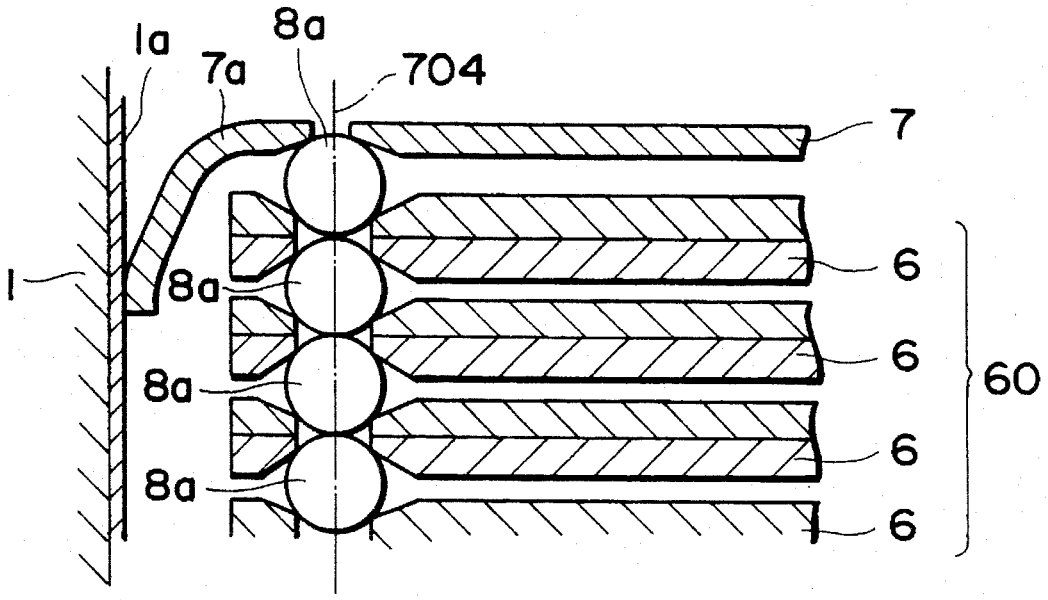
FIG. 5 is a sectional view for explaining the arrangement state of the focusing electrode plate shown in FIGS. 2 and 3.

In the photomultiplier using the focusing electrode plate 7 shown in FIG. 2, a conductive metal film **1*a* is formed in a predetermined region (the holding springs 7*a* are brought into contact with this region, FIG. 5) of the inner wall of the housing 1 having the dynode unit therein. This conductive metal film 1*a* and the photocathode 3 are rendered conductive by a conductive metal member 12 to equalize the potentials of the focusing electrode plate 7 and the photocathode 3 (see FIGS. 1, 13 and 15**).

Engaging members 9 (each engaging member 9 is constituted by a pair of guide pieces **9*a* and 9*b* for guiding the connecting pin 11) engaged with connecting pins 11 for applying a predetermined voltage are integrally formed with the focusing electrode plate 7**.

The second application of a focusing electrode plate 7 is shown in FIG. 3. Contact terminals **7*b* directly in contact with a photocathode 3 are integrally formed with this focusing electrode plate 7 to equalize the potentials of the photocathode 3 and the focusing electrode plate 7 and function as springs. In this case, the above-described conductive metal member 12** is not needed.

The anode is supported by the anode plate 5. A plurality of anodes are provided to this anode plate 5, and electron passage holes through which secondary electrons pass are formed in the anode plate 5 in correspondence with positions where the secondary electrons emitted from the last-stage of the dynode unit 60 reach. Therefore, this photomultiplier has, between the anode plate 5 and the base member 4, an inverting dynode plate 13 for supporting inverting dynodes in parallel to the anode plate 5. The inverting dynode plate 13 inverts the orbits of the secondary electrons passing through the anode plate 5 toward the anodes. The diameter of the electron incident port (dynode unit 60 side) of the electron passage hole formed in the anode plate 5 is smaller than that of the electron exit port (inverting dynode plate 13 side). The inverting dynode plate 13 has, at positions opposing the anodes, a plurality of through holes for injecting a metal vapor to form a secondary electron emitting layer on the surface of each dynode 6 of the dynode unit 60.

On the other hand, the photomultiplier may have, between the inverting dynode plate 13 and the base member 4, a shield electrode plate 14 for supporting sealed electrodes in parallel to the inverting dynode plate 13. The shield electrode plate 14 inverts the orbits of the secondary electrons passing through the anode plate 5 toward the anodes. The shield electrode plate 14 has a plurality of through holes for injecting a metal vapor to form a secondary electron emitting layer on the surface of each dynode 6 of the dynode unit 60. In place of this shield electrode plate 14, a surface portion 4*a* of the base member 4 opposing the anode plate 5 may be used as a sealed electrode and substituted for the shield electrode plate 14.

In particular, the electron multiplier comprises a dynode unit 60 constituted by stacking a plurality of dynode plates 6, spaced apart from each other at predetermined intervals by the insulating members 8*a* and 8*b* in the incidence direction of the electron flow, and each dynode plate 6 is supporting a plurality of dynodes for cascade-multiplying an incident electron flow, and the anode plate 5 opposing the last-stage dynode plate 6 of the dynode unit 60 through the insulating members 8*a* and 8*b*.

In this electron multiplier, each dynode plate 6 has an engaging member 9 at a predetermined position of a side surface of the plate to engage with a corresponding connecting pin 11 for applying a predetermined voltage. The side surface of the dynode plate 6 is in parallel with respect to the incident direction of the photoelectrons. The engaging member 9 is constituted by a pair of guide pieces 9*a* and 9*b* for guiding the connecting pin 11. The engaging member may have a hook-like structure (engaging member 99 illustrated in FIG. 1). The shape of this engaging member is not particularly limited as long as the connecting pin 11 is received and engaged with the engaging member. On the other hand, a portion near the end portion of the connecting pin 11, which is brought into contact with the engaging member 9, may be formed of a metal material having a rigidity lower than that of the remaining portion.

Each dynode plate 6 used is constituted by two plates having openings for forming the dynodes and integrally formed by welding such that the openings are matched with each other to function as dynodes when the two plate are overlapped each other. To integrally form the two plates by welding, the two plates have projecting pieces 10 for welding the corresponding side surfaces thereof at predetermined positions matching when the two plates 6*a* and 6*b* are overlapped each other.

Figure 4:
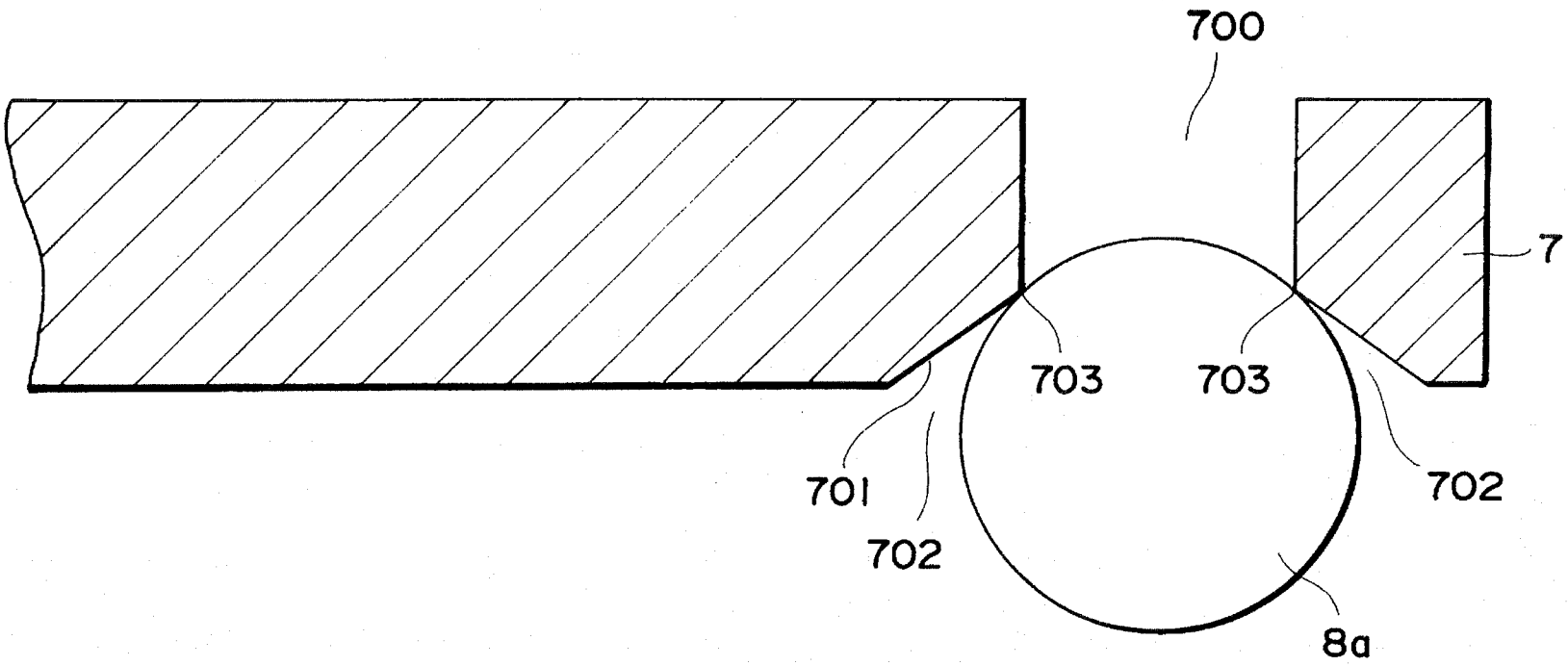
FIG. 4 is a sectional view for explaining the structure of a concave portion provided to the focusing electrode plate shown in FIGS. 2 and 3.

The structure of the focusing electrode plate 7 will be described below. FIG. 4 is a sectional view showing the focusing electrode plate 7. Referring to FIG. 4, the focusing electrode plate 7 has, in at least the first main surface which opposes in parallel to the incident side (first-stage dynode plate 6) of the dynode unit 60, a concave portion 701 for arranging an insulating member 8*a* (or 8*b*) which is partially in contact with the concave portion 701. To stably arrange this insulating member 8*a*, a through hole 700 is formed to extend from the concave portion 701 to the second main surface in an opposite side of the first main surface.

A gap 702 is formed between the main surface of the concave portion 701 and the main surface of the insulating member 8*a* to prevent discharge between the focusing electrode plate 7 and the first-stage dynode plate 6. Therefore, an interval from a contact portion 703 between the insulating member 8*a* and the focusing electrode plate 7 to the second main surface of the focusing electrode plate 7 is smaller than that (thickness of the focusing electrode plate 7) from the first main surface to the second main surface of the focusing electrode plate 7.

A similar concave portion for partially arranging an insulating member may be formed in the main surface of each dynode plate 6 for constituting the dynode unit 60.

FIG. 5 is a sectional view showing a state in which the focusing electrode plate 7 is fixed to the dynode unit 60 constituted by a plurality of dynode plates 6. As shown in FIG. 5, the insulating member 8*a* sandwiched between the focusing electrode plate 7 and the first-stage dynode plate 6 and the insulating members 8*a* sandwiched between the two dynode plates 6 are in direct contact with the adjacent insulating members 8*a*. The central points of these insulating members are aligned on the same line 704 to obtain a higher mechanical strength in the stacking direction of the dynode plates 6. With this structure, damage to the dynode plates 6 or the focusing electrode plate 7 can be prevented, and the intervals between the dynode plates 6 can be sufficiently kept.

Using spherical or cylindrical bodies 8*a* or 8*b* as the insulating members, the photomultiplier can be easily manufactured. In particular, when cylindrical bodies are used, the outer surfaces of these bodies are brought into contact with each other. The shape of the insulating member is not limited to this. For example, an insulating member having an elliptical or polygonal section can also be used as long as the object of the present invention can be achieved. A secondary electron emitting layer containing an alkali metal is formed on the surface of the dynode supported by each dynode plate 6.

The shapes of the concave portion will be described below with reference to FIGS. 6 to 9. For the sake of descriptive convenience, only a portion corresponding to one main surface of the focusing electrode plate 7 or the dynode plate 6 (to be referred to as the plate hereinafter) is disclosed in FIGS. 6 to 9.

Figure 6:
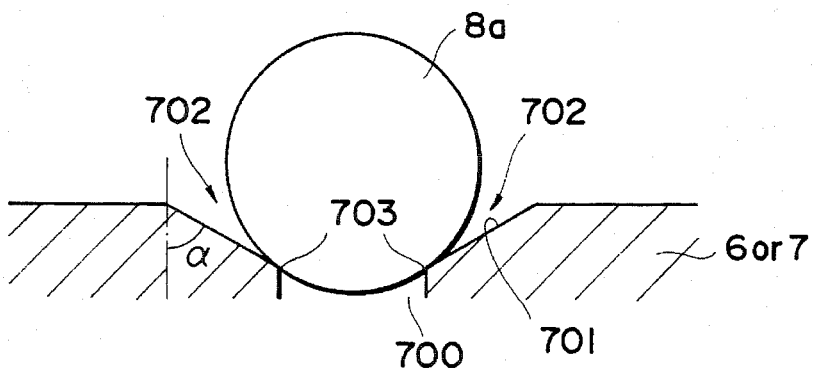
FIG. 6 is a sectional view showing the structure of the concave portion as the first application of the concave portion shown in FIG. 5.

The concave portion 701 is generally constituted by a surface having a predetermined taper angle ($\alpha$) with respect to the direction of thickness of the plate 6 or 7, as shown in FIG. 6.

Figure 7:
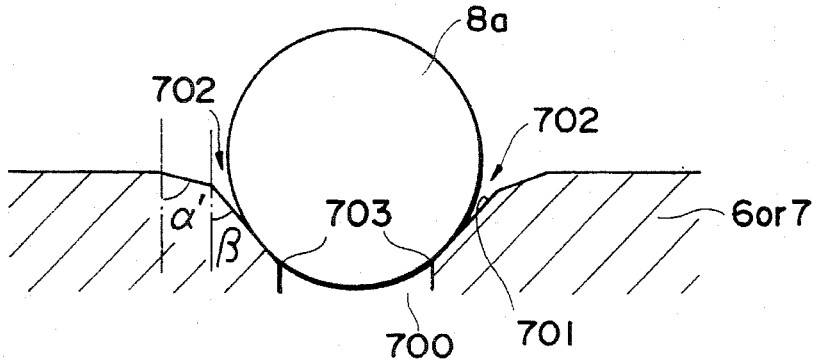
FIG. 7 is a sectional view showing the structure of the concave portion as the second application of the concave portion shown in FIG. 5.

This concave portion 701 may be constituted by a plurality of surfaces having predetermined taper angles ($\alpha$ and $\beta$) with respect to the direction of thickness of the plate 6 or 7, as shown in FIG. 7.

Figure 8:
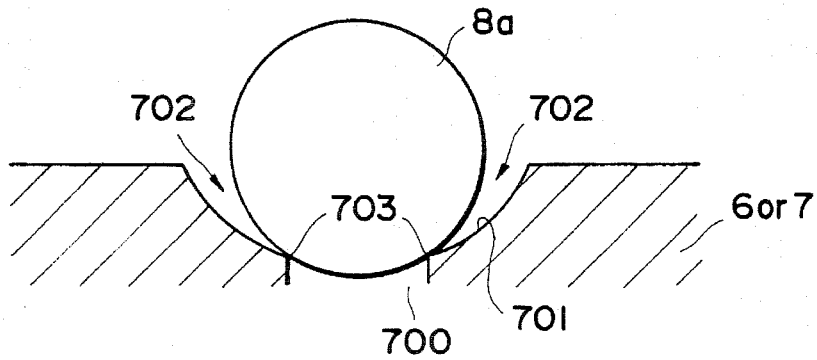
FIG. 8 is a sectional view showing the structure of the concave portion as the third application of the concave portion shown in FIG. 5.

The surface of the concave portion 701 may be a curved surface having a predetermined curvature, as shown in FIG. 8. The curvature of the surface of the concave portion 701 is set smaller than that of the insulating member 8*a*, thereby forming the gap 702 between the main surface of the concave portion 701 and the surface of the insulating member 8*a*.

Figure 9:
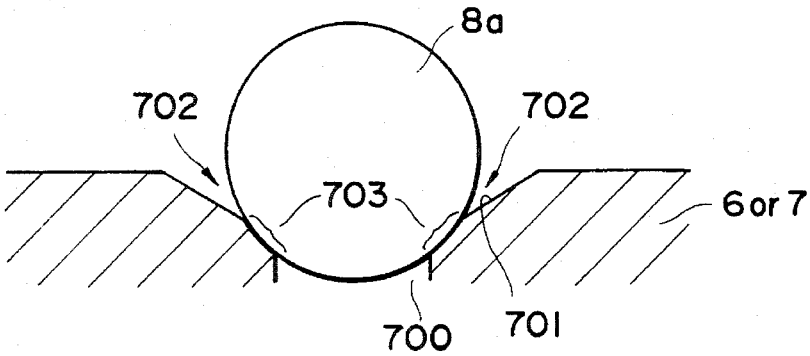
FIG. 9 is a sectional view showing the structure of the concave portion as the fourth application of the concave portion shown in FIG. 5.

To obtain a stable contact state with respect to the insulating member 8*a*, a surface to be brought into contact with the insulating member 8*a* may be provided to the concave portion 701, as shown in FIG. 9. In this embodiment, a structure having a high mechanical strength against a pressure in the direction of thickness of the plate 6 or 7 even compared to the above-described structures in FIGS. 6 to 8 can be obtained.

Figure 10:
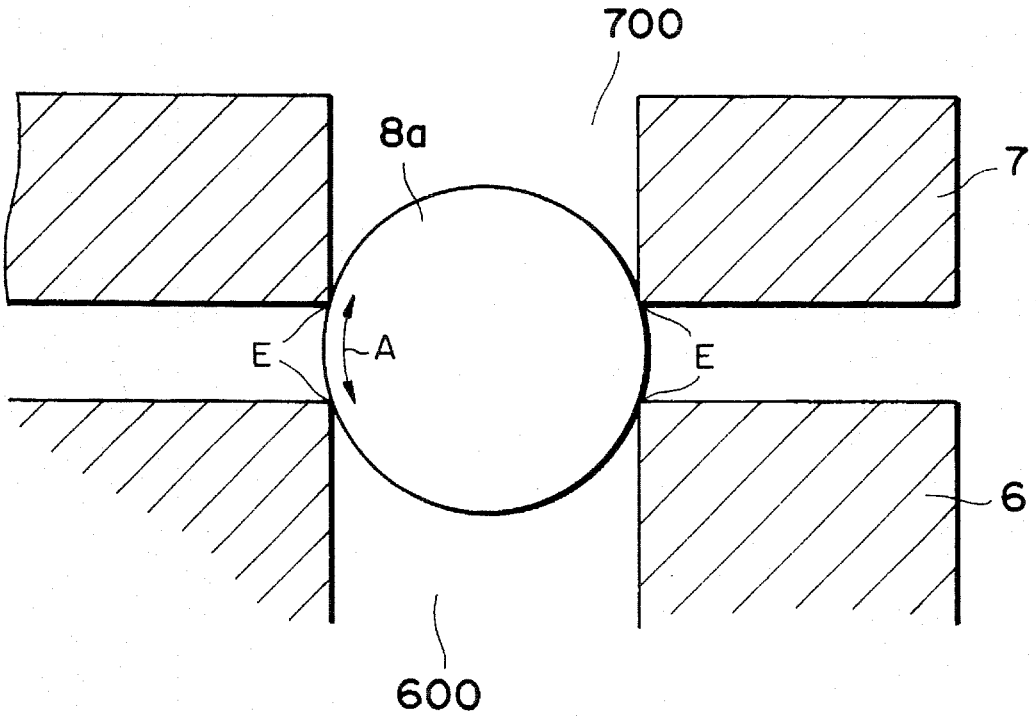
FIG. 10 is a sectional view showing the structure of a comparative example, for explaining the effect of the present invention.
Figure 11:
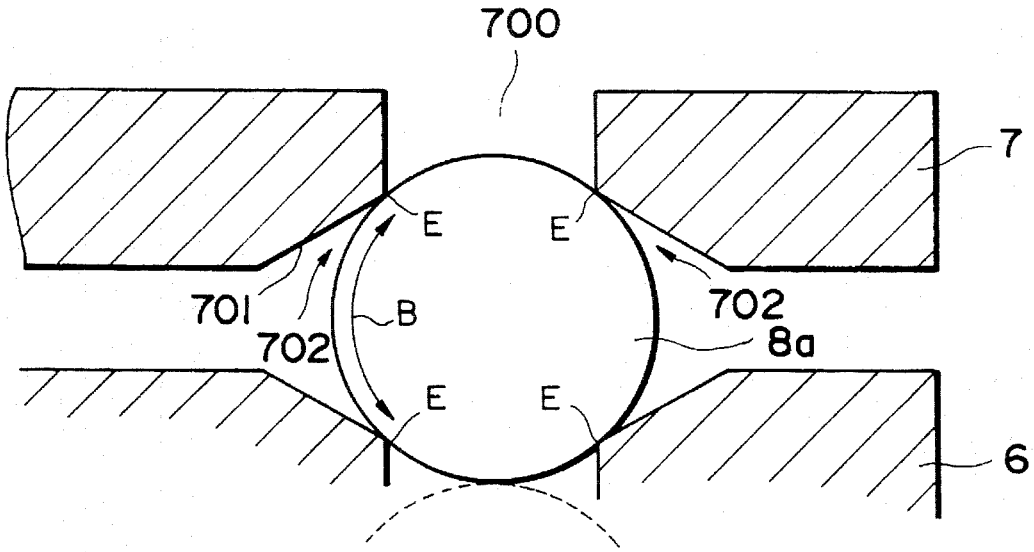
FIG. 11 is a sectional view showing the structure between the focusing electrode plate and a dynode plate, for explaining the effect of the present invention.

The detailed structure between focusing electrode plate 7 and the first-stage dynode plate 6 of the dynode unit 60 will be described below with reference to FIGS. 10 and 11. FIG. 10 is a partial sectional view showing a photomultiplier having only the through hole 700 as a comparative example of the present invention. FIG. 11 is a partial sectional view showing the photomultiplier according to an embodiment of the present invention.

In the comparative example shown in FIG. 10, the interval between the focusing electrode plate 7 and the dynode plate 6, both of which have no concave portion, is almost the same as a distance A (between contact portions E between the plates 6 and 7 and an insulating member 102) along the surface of the insulating member 8*a*.

On the other hand, in an embodiment of the present invention shown in FIG. 11, since concave portions are formed, a distance B (between the contact portions E between the plates 6 and 7 and the insulating member 8*a*) along the surface of the insulating member 8*a* is larger than the interval between plates 6*a* and 6*b*. Generally, discharge between the focusing electrode plate 7 and the dynode plate 6 is assumed to be caused along the surface of the insulating member 8*a* due to dust or the like deposited on the surface of the insulating member 8*a*. Therefore, as shown in this embodiment (FIG. 11), when the concave portions are formed, the distance B along the surface of the insulating member 8*a* increases as compared to the interval between the focusing electrode plate 7 and the first-stage dynode plate 6 (or interval between the dynode plate 6 adjacent to each other), thereby preventing discharge which occurs when the insulating member 8*a* is disposed in a space which is sandwiched between the plates 6 and 7.

The above description can also be applied to the structure between the dynode plates 6 for constituting the dynode unit 60. Therefore, when concave portions are formed in the opposing main surfaces of the dynode plates 6, a photomultiplier having structural and electrical stability can be obtained.

The detailed structure of this photomultiplier will be described with reference to FIGS. 12 to 15.

Figure 12:
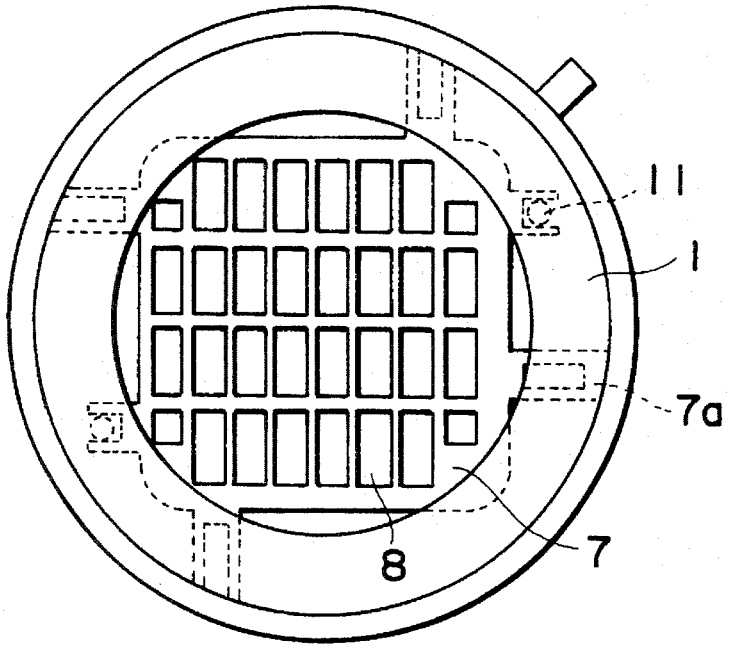
FIG. 12 is a plan view showing the photomultiplier viewed from the top in an embodiment of the photomultiplier according to the present invention.
Figure 13:
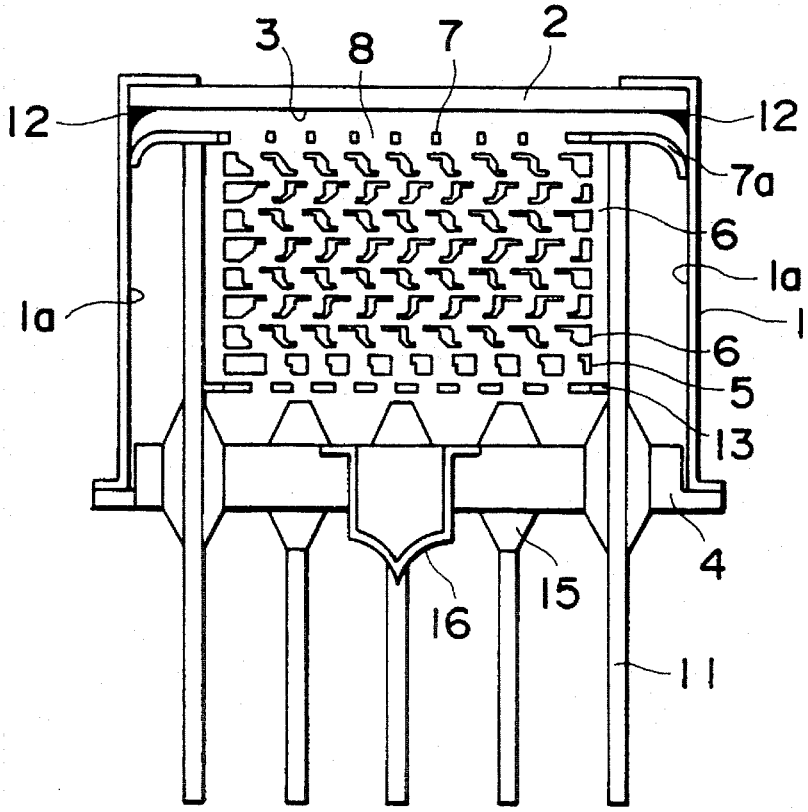
FIG. 13 is a sectional side view showing the simple internal structure of the photomultiplier, in which a metal housing 1 in the photomultiplier according to the embodiment in FIG. 12 is cut.

The structure of the photomultiplier according to the first embodiment of the present invention is shown. FIG. 12 is a plan view showing the photomultiplier shown in FIG. 1. FIG. 13 is a sectional view showing the photomultiplier shown in FIG. 1. In this photomultiplier, a vacuum container is constituted by a circular light receiving plate 2 for receiving incident light, a cylindrical metal housing 1 disposed along the outer circumference of the light receiving plate 2, and a circular stem 4 serving as a base member. An electron multiplier (including anodes and a dynode unit 60) for cascade-multiplying the incident electron flow is disposed in this vacuum container.

On the lower surface of the light receiving plate 2, after MnO or Cr is vacuum-deposited, Sb is deposited, and an alkali metal such as K or Cs is then formed and activated to form a photocathode 3. The potential of this photocathode 3 is held at 0 V.

A focusing electrode plate 7 formed of a stainless plate is disposed between the photocathode 3 and the electron multiplier. This focusing electrode plate 7 is constituted by focusing electrodes 8 which are constituted by a plurality of openings arranged in a matrix at pitches of 1 mm and four holding springs 7*a* which are formed at the peripheral portion of the focusing electrode plate 7 and whose distal ends having the same curvature as that of the inner wall of the housing 1 are satisfactorily in contact with the inner wall of the housing 1. The potential of this focusing electrode plate 7 is held equal to that of the photocathode 3. Therefore, the orbits of the photoelectrons emitted from the photocathode 3 are focused and incident on a predetermined region of the electron multiplier, especially on the surface of the first-stage dynode plate 6 of the dynode unit, by the focusing electrodes 8.

A conductive aluminum film 1*a* is formed on the inner wall of the housing 1 which surrounds the photocathode 3 and the focusing electrode plate 7. The aluminum film 1*a* is electrically connected to the photocathode 3 by a conductive metal member 12 which is formed of the same material as that of the aluminum film 1*a*. Therefore, a current is supplied from the holding springs 7*a* in contact with the inner wall of the housing 1 to the photocathode 3 through the aluminum film 1*a* and the conductive metal member 12. Normally, the aluminum film 1*a* and the conductive metal member 12 are formed such that Ag dissolved by isoacyl acetate is coated on the inner wall of the housing 1 and then calcined at a high temperature.

The dynode unit 60 is constituted by stacking seven stages of dynode plates 6 formed into square flat plates. A plurality of dynodes are formed and arranged in a matrix in each dynode plate 6. An anode plate 5 for supporting the anodes and an inverting dynode plate 13 for supporting inverting dynodes are sequentially disposed under the multilayered dynodes.

Connecting pins 11 which are connected to external voltage terminals to apply a predetermined voltage to the focusing electrode plate 7, the dynode plates 6, and the inverting dynode plate 13 extend through the stem 4 serving as the base member. Each connecting pin 11 is fixed to the stem 4 by hermetic glass 15. A metal tip tube 16 having an end portion pressed and sealed is projected downward from the center of the stem 4. This metal tip tube 16 is used to introduce an alkali metal into the vacuum container or evacuate the vacuum container. Therefore, after these operations are completed, the metal tip tube 16 is sealed, as shown in FIG. 13. Taking the breakdown voltage or leakage current into consideration, the hermetic glass 15 is formed such that its side surface has a predetermined taper angle with respect to the main surface of the stem 4 opposite to the main surface thereof on which the dynode unit 60 mounted.

According to the above structure, one focusing electrode plate 7 and the four holding springs 7*a* are integrally formed to unify these five components. For this reason, the number of components is decreased, thereby improving the operation efficiency at the time of assembly.

Additionally, since it becomes unnecessary to resistance-weld two portions (between the inner wall of the housing 1 and the holding spring 7*a* and between the holding spring 7*a* and the focusing electrode plate 7) for each holding spring 7*a*, the number of welding points is decreased by eight in total. For this reason, field discharge upon application of a high voltage is prevented to reduce the noise. Therefore, reliability and the operation efficiency at the time of welding are improved.

Figure 14:
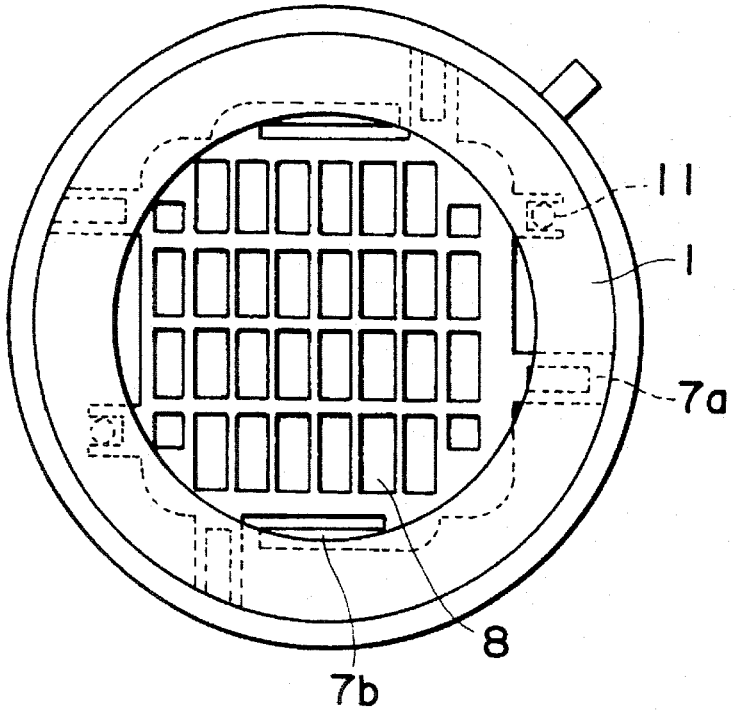
FIG. 14 is a plan view showing the photomultiplier viewed from the top in the photomultiplier according to another embodiment of the present invention.
Figure 15:
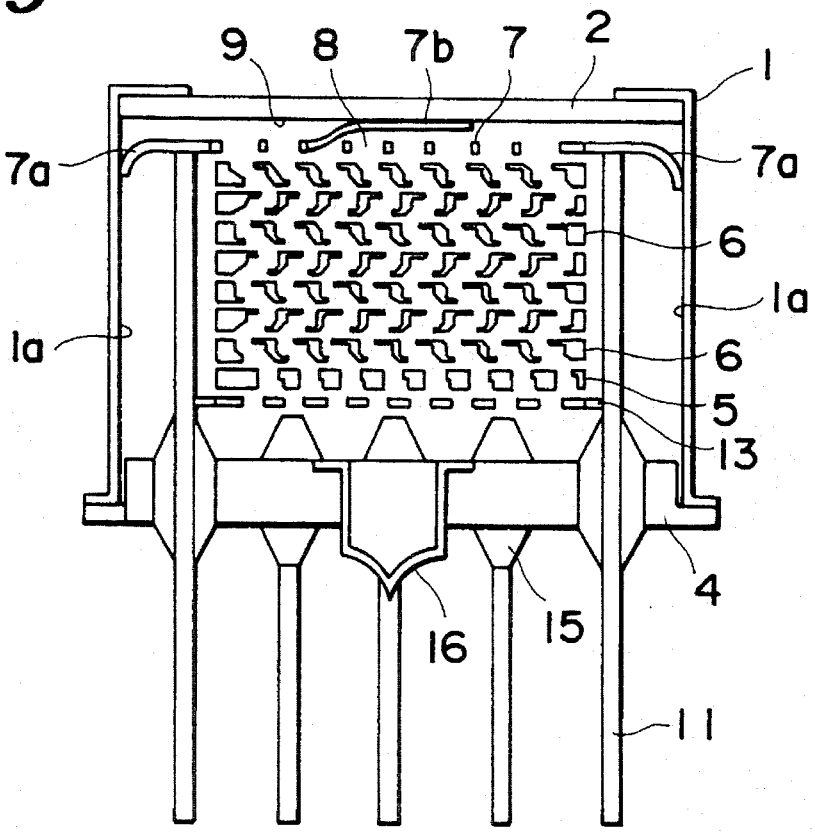
FIG. 15 is a sectional side view showing the simple internal structure of the photomultiplier, in which the housing 1 for constituting a vacuum container in the photomultiplier according to the embodiment in FIG. 14 is cut.

The structure of the photomultiplier according to the second embodiment of the present invention is shown. FIG. 14 is a plan view showing the photomultiplier shown in FIG. 1. FIG. 15 is a sectional view showing the photomultiplier shown in FIG. 1. This photomultiplier has almost the same structure as in the first embodiment. However, a focusing electrode plate 7 is constituted by focusing electrodes 8 comprising a plurality of openings which are disposed at pitches of 1 mm, four holding springs 7*a* which are formed at the peripheral portion of this focusing electrode plate 7 and whose distal ends having almost the same curvature as that of the inner wall of a housing 1 are satisfactorily in contact with the inner wall of the housing 1, and two contact terminals 7*b* whose semicircular distal ends are in direct contact with the peripheral portion of a photocathode 3 outside the light receiving region. Therefore, the potential of the focusing electrode plate 7 is held equal to that of the photocathode 3. The two contact terminals 7*b* are formed in opposite directions by etching or the like. No conductive metal film is formed on the inner wall of the housing 1. A current is directly supplied from the contact terminals 7*b* to the photocathode 3.

According to the above structure, one focusing electrode plate 7, the four holding springs 7*a*, and the two contact terminals 7*b* are integrally formed to unify these seven components. For this reason, the number of components is decreased, thereby improving the operation efficiency at the time of assembling.

Since it becomes unnecessary to resistance-weld two portions for one contact terminal 7*b* or holding spring 7*a*, the number of welding points is decreased by 12 in total. For this reason, field discharge upon application of a high voltage is prevented to reduce the noise. Therefore, reliability and the operation efficiency at the time of welding are improved.

In addition, since the contact terminals 7*b* are directly, mechanically, and electrically connected to the photocathode 3, the number of factors for degrading the photoelectric surface of the photocathode 3 and the secondary electron emitting surface of each dynode plate 6. For this reason, the multiplication factor of the output signal for the incident light is not decreased, thereby improving the reliability.

The present invention is not limited to the above embodiments, and various modifications can be made.

For example, in the above embodiments, the multilayered dynodes are used as the dynode unit. However, an MCP (micro channel plate), semiconductor element or the like can also be used to obtain the same function and effect.

In the above embodiments, the hermetic glass is formed into a shape tapered from the surface of the stem 4. However, when the operating voltage is low, the diameter of the glass can be made uniform or increased.

The anodes used in the above embodiments may be replaced with a multi-anode fit in fitting holes extending through the stem and rectangularly arranged. In this case, output signals are extracted from a plurality of anode pins disposed crosswise and vertically mounted on the multi-anode, thereby detecting the position.

In the above embodiments, a plurality of connecting pins 11 vertically extend through the stem 4 through the hermetic glass and are rectangularly arranged. When the hermetic glass is fit to entirely cover fitting holes which extend through the stem and are arranged in a circle, and a plurality of pins directly extend through the hermetic glass along its periphery, the number of components can be decreased to reduce the cost.

As has been described above in detail, according to the present invention, the focusing electrode plate, the holding springs, and the contact terminals are integrally formed to decrease the number of components. Since the number of welding points needed at the time of welding is decreased, field discharge upon application of a high voltage is prevented to reduce the noise. Therefore, the reliability and the operation efficiency at the time of manufacturing are improved.

In addition, since the contact terminals are directly, electrically, and mechanically connected to the photocathode, the aluminum film formed on the inner wall of the vacuum tube becomes unnecessary. For this reason, the factors for degrading the photoelectric surface of the photocathode and the secondary electron emitting surface of each dynode plate are reduced. For this reason, the multiplication factor of the output signal for the incident light is not decreased, thereby improving the reliability.

Further, the concave portions in which the insulating members for holding predetermined intervals between the plates are arranged are formed in the focusing electrode plate and the dynode plates for constituting the dynode unit.

These concave portions are provided in the major surfaces of the plates to realize a structure for preventing discharge between the plates.

What is claimed is:

1. A photomultiplier comprising:

a housing for fabricating a vacuum container;

a photocathode provided in said housing;

an anode provided in said housing;

an electron multiplier for cascade-multiplying photoelectrons emitted from said photocathode, said electron multiplier provided between said photocathode and said anodes in said housing; and a focusing electrode plate provided between said photocathode and said electron multiplier and fixed on said electron multiplier through insulating members, said focusing electrode plate having holding springs pressed against an inner wall of said housing to hold an arrangement position of said electron multiplier.

2. A photomultiplier according to claim 1, wherein said focusing electrode has at least one contact terminal brought into direct contact with said photocathode to equalize potentials of said photocathode and said focusing electrode plate.

3. A photomultiplier comprising:

a housing for fabricating a vacuum container;

a photocathode provided in said housing;

an anode provided in said housing;

an electron multiplier for cascade-multiplying photoelectrons emitted from said photocathode, said electron multiplier provided between said photocathode and said anodes in said housing; and a focusing electrode plate for supporting at least one focusing electrode for correcting orbits of the photoelectrons emitted from said photocathode, provided between said photocathode and said electron multiplier, and fixed on a photoelectron incident side of said electron multiplier through insulating members, said focusing electrode plate having holding springs integrally formed with said focusing electrode plate and pressed against an inner wall of said housing to hold an arrangement position of said electron multiplier.

4. A photomultiplier comprising:

a housing for fabricating a vacuum container;

a photocathode provided in said housing;

an anode provided in said housing;

an electron multiplier for cascade-multiplying photoelectrons emitted from said photocathode, said electron multiplier provided between said photocathode and said anodes in said housing; and a focusing electrode plate for supporting at least one focusing electrode for correcting orbits of the photoelectrons emitted from said photocathode, provided between said photocathode and said electron multiplier, and fixed on a photoelectron incident side of said electron multiplier through insulating members, said focusing electrode plate having:

holding springs integrally formed with said focusing electrode plate and pressed against an inner wall of said housing to hold an arrangement position of said electron multiplier; and at least one contact terminal integrally formed with said focusing electrode plate and brought into direct contact with said photocathode to equalize potentials of said photocathode and said focusing electrode plate.

5. A photomultiplier comprising:

a photocathode;

an anode plate for supporting at least one anode;

a dynode unit provided between said photocathode and said anode plate and constituted by stacking a plurality of stages of dynode plates such that a last-stage dynode plate of said dynode unit opposes said anode plate in parallel, said dynode plates spaced apart from each other at predetermined intervals through insulating members in an incident direction of photoelectrons emitted from said photocathode, each dynode plate for supporting at least one dynode for cascade-multiplying said photoelectrons; and a focusing electrode plate for supporting at least one focusing electrode and for focusing and guiding the photoelectrons emitted from said photocathode to a first-stage dynode plate, said focusing electrode plate opposing said first-stage dynode plate of said dynode unit, fixed parallel to said dynode unit through insulating members, and having a concave portion for arranging an insulating member which is partially in contact with said concave portion on a first main surface opposing at least said first-stage dynode plate, wherein a gap is formed between a main surface of said concave portion and a surface of said insulating member to prevent discharge between said focusing electrode plate and said first-stage dynode plate which opposes said focusing electrode plate.

6. A photomultiplier according to claim 5, wherein a concave portion is provided in a main surface of said first-stage dynode plate of said dynode unit, which opposes said focusing electrode plate, to arrange said insulating member partially in contact with said concave portion of said focusing electrode plate such that said insulating member is partially brought into contact with said concave portion of said first-stage dynode plate, and an interval from a contact portion between said concave portion provided in said focusing electrode plate and said insulating member to a contact portion between said concave portion of said first-stage dynode plate and said insulating member is larger than that from said focusing electrode plate to said first-stage dynode plate.

7. A photomultiplier according to claim 5, wherein said insulating member sandwiched between said concave portion of said focusing electrode plate and a concave portion of said first-stage dynode plate is a spherical body.

8. A photomultiplier according to claim 5, wherein said insulating member sandwiched between said concave portion of said focusing electrode plate and a concave portion of said first-stage dynode plate is a circularly cylindrical body.

9. A photomultiplier according to claim 5, wherein said focusing electrode plate has at least one contact terminal brought into contact with said photocathode to equalize potentials of said focusing electrode and said photocathode, said contact terminal being integrally formed with said focusing electrode plate.

10. A photomultiplier according to claim 5, wherein each of said dynode plates for constituting said dynode unit comprises a first concave portion for arranging a first insulating member which is provided on a first main surface of said dynode plate and partially in contact with said first concave portion, and a second concave portion for arranging a second insulating member which is provided on a second main surface opposing said first main surface and partially in contact with said second concave portion, said second concave portion communicating with said first concave portion through a through hole, said first insulating member arranged on said first concave portion and said second insulating member arranged on said second concave portion are in direct contact with each other in said through hole, and an interval between a contact portion between said first concave portion and said first insulating member and a contact portion between said second concave portion and said second insulating member is smaller than that between said first and second main surfaces of said dynode plate.

11. A photomultiplier according to claim 10, wherein gaps are formed between a surface of said first insulating member and a main surface of said first concave portion and between said second insulating member and a main surface of said second concave portion, respectively, to prevent discharge between said dynode plates.

12. A photomultiplier according to claim 11, wherein a central point of said first insulating member, a central point of said second insulating member, and a contact point between said first and second insulating members are aligned on the same line in a stacking direction of said dynode plates.

13. A photomultiplier according to claim 12, wherein a central point of said insulating member sandwiched between said concave portion of said focusing electrode plate and said concave portion of said first-stage dynode plate of said dynode unit is also aligned on the same line in the stacking direction of said dynode plates.

14. A photomultiplier according to claim 10, wherein said first and second insulating members are spherical bodies.

15. A photomultiplier according to claim 10, wherein said first and second insulating members are circularly cylindrical bodies, and outer surfaces of said circularly cylindrical bodies are in contact with each other.

16. A photomultiplier according to claim 5, wherein said focusing electrode plate has an engaging member engaged with a corresponding connecting pin for applying a predetermined voltage at a predetermined position of a side surface of said plate, said side surface in parallel to the incident direction of said photoelectrons.

17. A photomultiplier according to claim 5, wherein each of said dynode plates has an engaging member engaged with a corresponding connecting pin for applying a predetermined voltage at a predetermined position of a side surface of said plate, said side surface in parallel to the incident direction of said photoelectrons.

18. A photomultiplier according to claim 17, wherein said engaging member is constituted by a pair of guide pieces for guiding said corresponding connecting pin.

19. A photomultiplier according to claim 5, wherein a plurality of anodes are provided to said anode plate, and electron passage holes through which secondary electrons pass in correspondence with positions where the secondary electrons emitted from a last-stage dynode of said dynode unit reach, and further comprising an inverting dynode plate, arranged parallel to said last-stage dynode plate at a position where said anode plate is sandwiched between said inverting dynode plate and said last-stage dynode plate of said dynode unit, for inverting orbits of the secondary electrons passing through said anode plate toward said anodes.

20. A photomultiplier according to claim 19, wherein a diameter of an electron exit port of said electron passage hole formed in said anode plate is larger than that of an electron incident port.

21. A photomultiplier according to claim 19, wherein said inverting dynode plate has, at positions opposing said anodes, a plurality of through holes for injecting a metal vapor to form a secondary electron emitting layer on a surface of each dynode of said dynode unit.

22. A photomultiplier according to claim 19, further comprising a shield electrode plate, arranged parallel to said anode plate at a position where said inverting dynode plate is sandwiched between said anode plate and said shield electrode plate, for inverting the orbits of the secondary electrons passing through said anode plate toward said anodes, said shield electrode plate having a plurality of through holes for injecting a metal vapor to form a secondary electron emitting layer on a surface of each dynode of said dynode unit.

23. A photomultiplier according to claim 5, wherein each one of said dynode plate is constituted by at least two plates, each having at least one opening for forming said dynode and integrally formed by welding such that said openings of said two plates are matched with each other to function as said dynode when said two plates are overlapped.

24. A photomultiplier according to claim 23, wherein said two plates for constituting said dynode plate, each having at least one projecting piece at a predetermined portion of side surface thereof in parallel to the incident direction of said photoelectrons, and integrally formed by welding corresponding said projection pieces of said two plates at predetermined positions matching with each other when said two plates are overlapped.

25. A photomultiplier comprising:

a housing for fabricating a vacuum container, having a light receiving plate and a conductive metal film formed in a predetermined region of an inner wall;

a photocathode deposited on a surface of said light receiving plate in said housing;

a dynode unit constituted by stacking a plurality of stages of dynode plates in an incident direction of photoelectrons emitted from said photocathode, each said dynode plate for supporting at least one dynode for receiving and cascade-multiplying said photoelectrons;

a base member, integrally formed with said housing and having said dynode unit mounted thereon, for guiding a plurality of connecting pins for applying a predetermined voltage to said dynode plates for constituting said dynode unit;

an anode plate for supporting at least one anode provided between said dynode unit and said base member;

a focusing electrode plate for supporting at least one focusing electrode for correcting orbits of the photoelectrons emitted from said photocathode, provided between said photocathode and said dynode unit, and fixed on an electron incident side of said dynode unit through insulating members, said focusing electrode plate having holding springs pressed against said inner wall of said housing, where said conductive metal film is formed, to hold an arrangement position of said dynode unit, and said holding springs and said focusing electrode plate being integrally formed; and a conductive metal member for electrically connecting said conductive metal film formed on said inner wall of said housing, which is in contact said holding springs, to said photocathode to equalize potentials of said focusing electrode plate and said photocathode.

26. A photomultiplier according to claim 25, wherein said focusing electrode plate has a concave portion in a major surface which opposes at least a first-stage dynode plate of said dynode unit in parallel to arrange an insulating member sandwiched between said focusing electrode plate and said first-stage dynode plate such that said insulating member is partially brought into contact with said concave portion, and a gap is formed between a main surface of said concave portion and a main surface of said insulating member to prevent discharge between said focusing electrode plate and said first-stage dynode plate.

27. A photomultiplier according to claim 25, wherein an interval from a contact portion between a concave portion of said focusing electrode plate and one of said insulating members to a contact portion between said one of said insulating members and said first-stage dynode plate of said dynode unit is larger than an interval from said focusing electrode plate to said first-stage dynode plate.

28. A photomultiplier according to claim 25, wherein one of said insulating members is sandwiched between said focusing electrode plate and said first-stage dynode plate of said dynode unit and is a spherical body.

29. A photomultiplier according to claim 25, wherein one of said insulating members is sandwiched between said focusing electrode and said first-stage dynode plate of said dynode unit and is a circularly cylindrical body.

30. A photomultiplier according to claim 25, wherein said focusing electrode plate has an engaging member engaged with a corresponding connecting pin for applying a predetermined voltage at a position of a side surface of said plate, said side surface in parallel to the incident direction of said photoelectrons.

31. A photomultiplier according to claim 30, wherein said engaging member is constituted by a pair of guide pieces for guiding said corresponding connecting pin.

32. A photomultiplier according to claim 30, wherein a portion near an end portion of said connecting pin, which is brought into contact with said engaging member, is formed of a metal material having a rigidity lower than that of a remaining portion.

33. A photomultiplier according to claim 25, wherein a plurality of anodes are provided to said anode plate, and electron passage holes through which secondary electrons pass in correspondence with positions where the secondary electrons emitted from a last stage of said dynode unit reach, and further comprising an inverting dynode plate, arranged parallel to said last-stage dynode plate at a position where said anode plate is sandwiched between said inverting dynode plate and said last-stage dynode plate of said dynode unit, for inverting orbits of the secondary electrons passing through said anode plate toward said anodes.

34. A photomultiplier according to claim 33, wherein a diameter of an electron exit port of said electron passage hole formed in said anode plate is larger than that of an electron incident port.

35. A photomultiplier according to claim 33, wherein said inverting dynode plate has, at positions opposing said anodes, a plurality of through holes for injecting a metal vapor to form a secondary electron emitting layer on a surface of each dynode of said dynode unit.

36. A photomultiplier according to claim 33, further comprising a shield electrode plate, arranged parallel to said anode plate at a position where said inverting dynode plate is sandwiched between said anode plate and said shield electrode plate, for inverting the orbits of the secondary electrons passing through said anode plate toward said anodes, said shield electrode plate having a plurality of trough holes for injecting a metal vapor to form a secondary electron emitting layer on a surface of each dynode of said dynode unit.

37. A photomultiplier comprising:

a housing for fabricating a vacuum container, said housing having a light receiving plate;

a photocathode deposited on a surface of said light receiving plate in said housing;

a dynode unit constituted by stacking a plurality of stages of dynode plates in an incident direction of photoelectrons emitted from said photocathode, each said dynode plate for supporting at least one dynode for receiving and cascade-multiplying said photoelectrons;

a base member, integrally formed with said housing and having said dynode unit mounted thereon, for guiding a plurality of connecting pins for applying a predetermined voltage to said dynode plates for constituting said dynode unit;

an anode plate for supporting at least one anode provided between said dynode unit and said base member; and a focusing electrode plate for supporting at least one focusing electrode for correcting orbits of the photoelectrons emitted from said photocathode, provided between said photocathode and said dynode unit, and fixed on a photoelectron incident side of said dynode unit through insulating members and having holding springs pressed against an inner wall of said housing, where a conductive metal film is formed, to hold an arrangement position of said dynode unit, said holding springs and said focusing electrode plate being integrally formed, and at least one contact terminal brought into direct contact with said photocathode to equalize potentials of said photocathode and said focusing electrode plate, said contact terminal and said focusing electrode plate being integrally formed.

38. A photomultiplier according to claim 37, wherein said focusing electrode plate has a concave portion in a major surface which opposes a first-stage dynode plate of said dynode unit in parallel to arrange an insulating member sandwiched between said focusing electrode plate and said first-stage dynode plate such that said insulating member is partially brought into contact with said concave portion, and a gap is formed between a main surface of said concave portion and a main surface of said insulating member to prevent discharge between said focusing electrode plate and said first-stage dynode plate.

39. A photomultiplier according to claim 37, wherein an interval from a contact portion between a concave portion of said focusing electrode plate and one of said insulating members to a contact portion between said one of said insulating members and said first-stage dynode plate of said dynode unit is larger than an interval from said focusing electrode plate to said first-stage dynode plate.

40. A photomultiplier according to claim 37, wherein one of said insulating members is sandwiched between said focusing electrode plate and said first-stage dynode plate of said dynode unit and is a spherical body.

41. A photomultiplier according to claim 37, wherein one of said insulating members is sandwiched between said focusing electrode plate and said first-stage dynode plate of said dynode unit and is a circularly cylindrical body.

42. A photomultiplier according to claim 37, wherein said focusing electrode plate has an engaging member engaged with a corresponding connecting pin for applying a predetermined voltage at a position of a side surface of said plate, said side surface in parallel to the incident direction of said photoelectrons.

43. A photomultiplier according to claim 42, wherein said engaging member is constituted by a pair of guide pieces for guiding said corresponding connecting pin.

44. A photomultiplier according to claim 42, wherein a portion near an end portion of said connecting pin, which is brought into contact with said engaging member, is formed of a metal material having a rigidity lower than that of a remaining portion.

45. A photomultiplier according to claim 37, wherein a plurality of anodes are provided to said anode plate, and electron passage holes through which secondary electrons pass in correspondence with positions where the secondary electrons emitted from a last stage of said dynode unit reach, and further comprising an inverting dynode plate, arranged parallel to said last-stage dynode plate at a position where said anode plate is sandwiched between said inverting dynode plate and said last-stage dynode plate of said dynode unit, for inverting orbits of the secondary electrons passing through said anode plate toward said anodes.

46. A photomultiplier according to claim 37, wherein a diameter of an electron exit port of an electron passage hole formed in said anode plate is larger than that of an electron incident port.

47. A photomultiplier according to claim 37, wherein an inverting dynode plate has, at positions opposing said anode, a plurality of through holes for injecting a metal vapor to form a secondary electron emitting layer on a surface of each dynode of said dynode unit.

48. A photomultiplier according to claim 37, further comprising a shield electrode plate, arranged parallel to said anode plate at a position where an inverting dynode plate is sandwiched between said anode plate and said shield electrode plate, for inverting the orbits of the secondary electrons passing through said anode plate toward said anodes, said shield electrode plate having a plurality of trough holes for injecting a metal vapor to form a secondary electron emitting layer on a surface of each dynode of said dynode unit.

* * * * *